US006769137B2

(12) United States Patent
D'Annunzio

(10) Patent No.: US 6,769,137 B2
(45) Date of Patent: Aug. 3, 2004

(54) CUTAWAY VESTS

(76) Inventor: Timothy B. D'Annunzio, 907 N. Magnolia St., Raeford, NC (US) 28376

( * ) Notice: Subject to any disclaimer, the term of this patent is extended or adjusted under 35 U.S.C. 154(b) by 469 days.

(21) Appl. No.: 10/008,391

(22) Filed: Oct. 24, 2001

(65) Prior Publication Data

US 2002/0120973 A1 Sep. 5, 2002

(51) Int. Cl.[7] ..... A41D 1/04

(52) U.S. Cl. ..... 2/102

(58) Field of Search ..... 2/102, 48, 69, 2/456, 460–463, 467, 44, 45, 50, 51, 69.5, 2.5, 94, 108, 326, 327–334; 244/151 R, 143, 151 A

(56) References Cited

U.S. PATENT DOCUMENTS

| | | | | | |
|---|---|---|---|---|---|
| 1,776,044 | A | * | 9/1930 | Roehm | 2/52 |
| 2,148,152 | A | * | 2/1939 | Dosberg | 2/52 |
| 2,442,895 | A | * | 6/1948 | Harvey | 2/48 |
| 4,545,773 | A | * | 10/1985 | Evert | 441/114 |
| 5,516,234 | A | * | 5/1996 | Duchesne | 405/186 |
| 6,421,833 | B2 | * | 7/2002 | Khanamirian et al. | 2/69 |

* cited by examiner

*Primary Examiner*—Tejash Patel
(74) *Attorney, Agent, or Firm*—Heslin Rothenberg Farley & Mesiti P.C.

(57) ABSTRACT

A cutaway vest generally includes a rear portion having an internal cummerbund, a front portion, and a pull cord. The cutaway vest includes a cutaway attachment in each shoulder and in the back for cutting away the shoulders, the sides, and the cummerbund upon pulling and removing a pull cord from the cutaway vest. The cutaway attachment may include a loop which is inserted through a ring and secured in place by a cable of the pull cord.

21 Claims, 8 Drawing Sheets

CUTAWAY VESTS

FIELD OF THE INVENTION

The present invention relates generally to garments, and more particularly to cutaway vests.

BACKGROUND OF THE INVENTION

Vests such as tactical vests and body armor vests are typically attached together at the shoulders and at the sides of a wearer typically using VELCRO fasteners, snap fasteners, buckles or other plastic-type hardware. In order for a wearer to get in and out of the vest, he must release several of the fasteners which is typically performed individually one at a time.

Attempts have been made for allowing a wearer to quickly remove the vest. For example, the inventor's earlier attempt at a readily releasable vest included front and rear portions which were attachable together at the shoulders and at the sides of the wearer. The rear portion included an internal cummerbund fixedly attached to the rear portion of the vest. The front of the cummerbund adjustably attached together around a wearer with hook-and-loop fasteners.

A handle was provided and attached to four cables for releasably attaching the front portion to the rear portion of the vest. For example, each of the shoulder portions of the rear portion of the vest included a flap. Each of the shoulder portions of the front of the vest included a tab portion on which was positioned a sleeve having a pocket. Attached to the outside of each sleeve was a folded webbing material which extended downwardly from the sleeve. Attached to the outside of the front portion of the vest adjacent to each of the shoulder portions was a ring. The folded webbing material was passed through the opening of the ring and releasably locked in place with one of the cables. The bottom of the flaps and the top of the sleeves were provided with hook-and-loop fasteners for releasably attaching the shoulder portions together.

Each side portion of the front and rear portions of the vest attached together with a strap having male and female buckle clasps disposed therebetween. In particular, one end of the strap was fixedly attached to the rear portion of the vest and included a male buckle clasp. The other end of the strap included a folded webbing material attached to a female buckle clasp. Attached to the inside of the front portion of the vest adjacent to each side was a ring. The folded webbing material was passed through the opening of the ring and releasably locked in place with one of the cables.

Removal of the vest required a wearer to perform a two-step process. In particular, the wearer initially pulled the handle attached to the cables to release the shoulder portions and the side portions of the vest. This permitted the front portion of the vest to fall away from the wearer. Thereafter, since the rear portion was held onto the wearer by the internal cummerbund, the wearer would then need to undo the front of the internal cummerbund to allow the rear portion of the vest to fall away from the wearer.

There is a need for further cutaway garments.

SUMMARY OF THE INVENTION

The present invention provides, in a first aspect, a cutaway garment having a front portion having a torso portion, spaced-apart shoulder portions, and opposite side portions, and a rear portion having a torso portion, spaced-apart shoulder portions, opposite side portions, and a cummerbund portion. A plurality of loops releasably attaches the spaced-apart shoulder portions of the front portion to the spaced-apart shoulder portions of the rear portion, the side portions of the rear portion to the rear portion, and an end of the cummerbund to the rear portion. A handle attaches to a plurality of cables, and the cables are operable to pass through the loops to attach the spaced-apart shoulder portions of the front portion to the spaced-apart shoulder portions of the rear portion, the side portions of the rear portion to the rear portion, and the end of the cummerbund to the rear portion. Removal of the plurality of cables from the loops allows cutting away the spaced-apart shoulder portions of the front portion from the spaced-apart portions of the rear portion, the side portions of the rear portion from the rear portion, and the end of the cummerbund from the rear portion.

The present invention provides, in a second aspect, a cutaway garment having a front portion having a torso portion, spaced-apart shoulder portions, and opposite side portions, and a rear portion having a torso portion, spaced-apart shoulder portions, opposite side portions, and a cummerbund portion. Means are provided for cutting away the spaced-apart shoulder portions of the front portion from the spaced-apart shoulder portions of the rear portion, the side portions of the rear portion from the rear portion, and a portion of the cummerbund from the rear portion.

BRIEF DESCRIPTION OF THE DRAWINGS

The subject matter which is regarded as the invention is particularly pointed out and distinctly claimed in the concluding portion of the specification. The invention, however, may be understood by reference to the following detailed description of the following embodiments and the accompanying drawings in which:

DETAILED DESCRIPTION OF THE INVENTION

Figure 1:
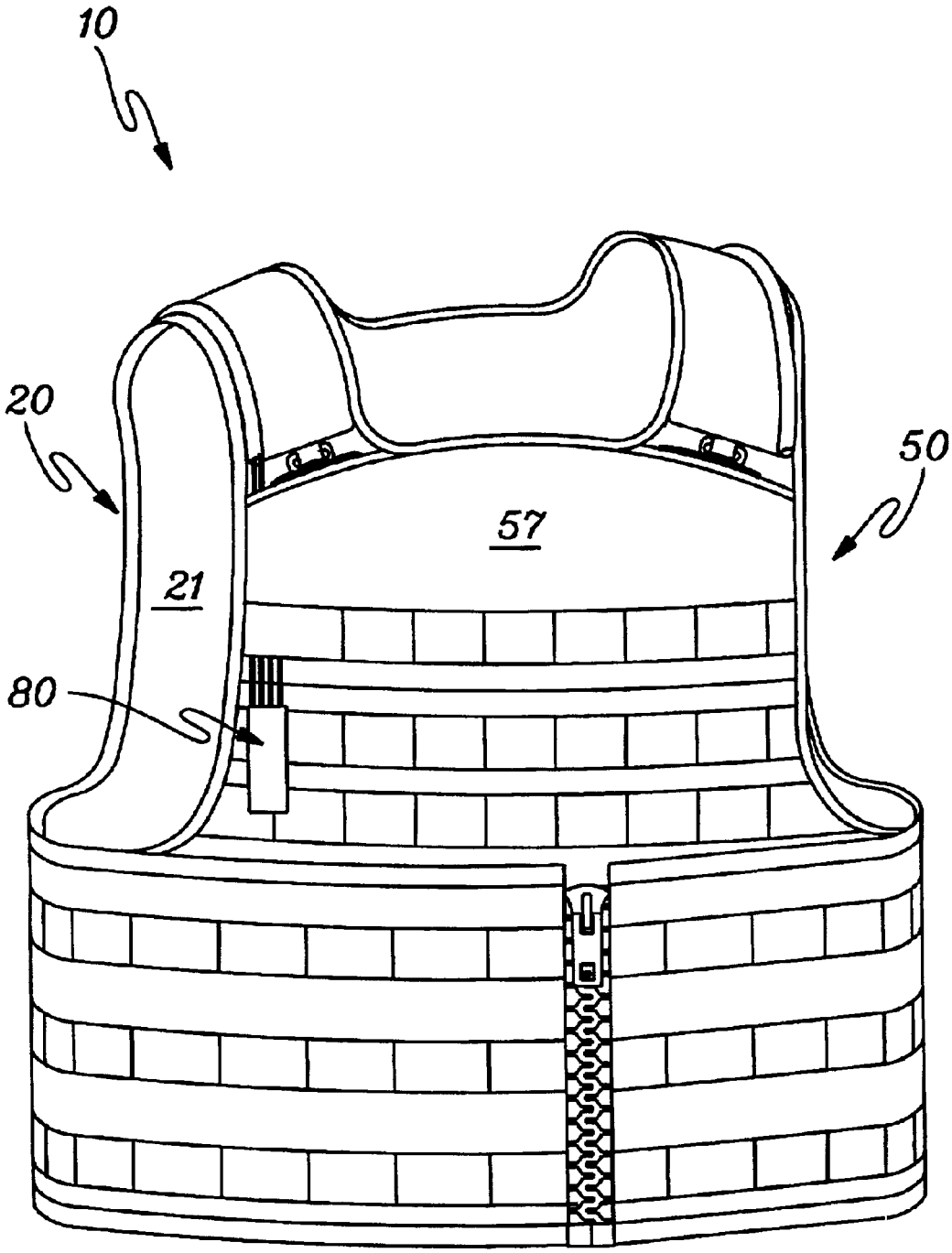
FIG. 1 is a perspective view of one embodiment of a cutaway vest in accordance with the present invention.
Figure 2:
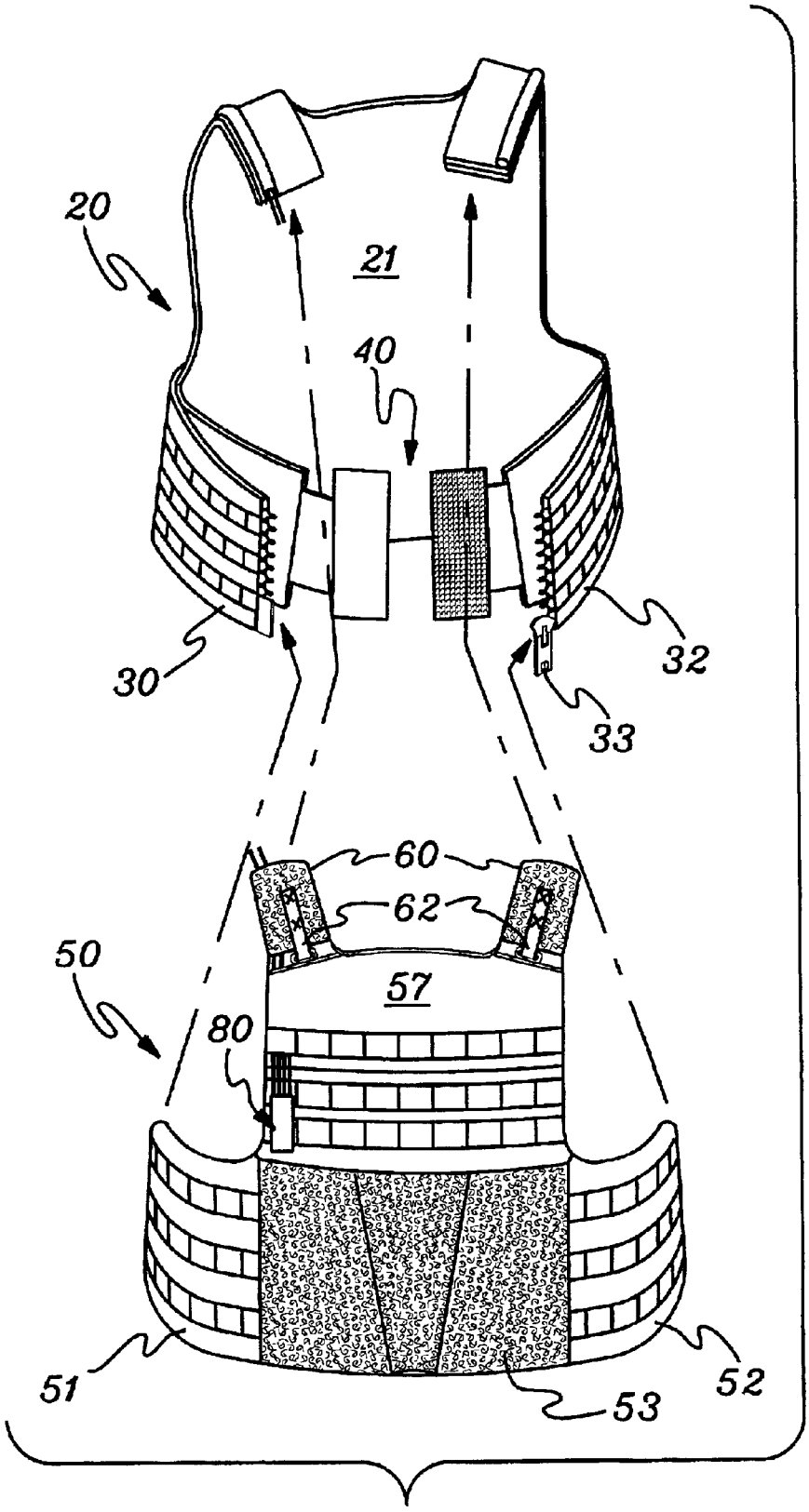
FIG. 2 is an exploded perspective view of the cutaway vest of FIG. 1 shown generally in an assembled, non-cutaway configuration.
Figure 3:
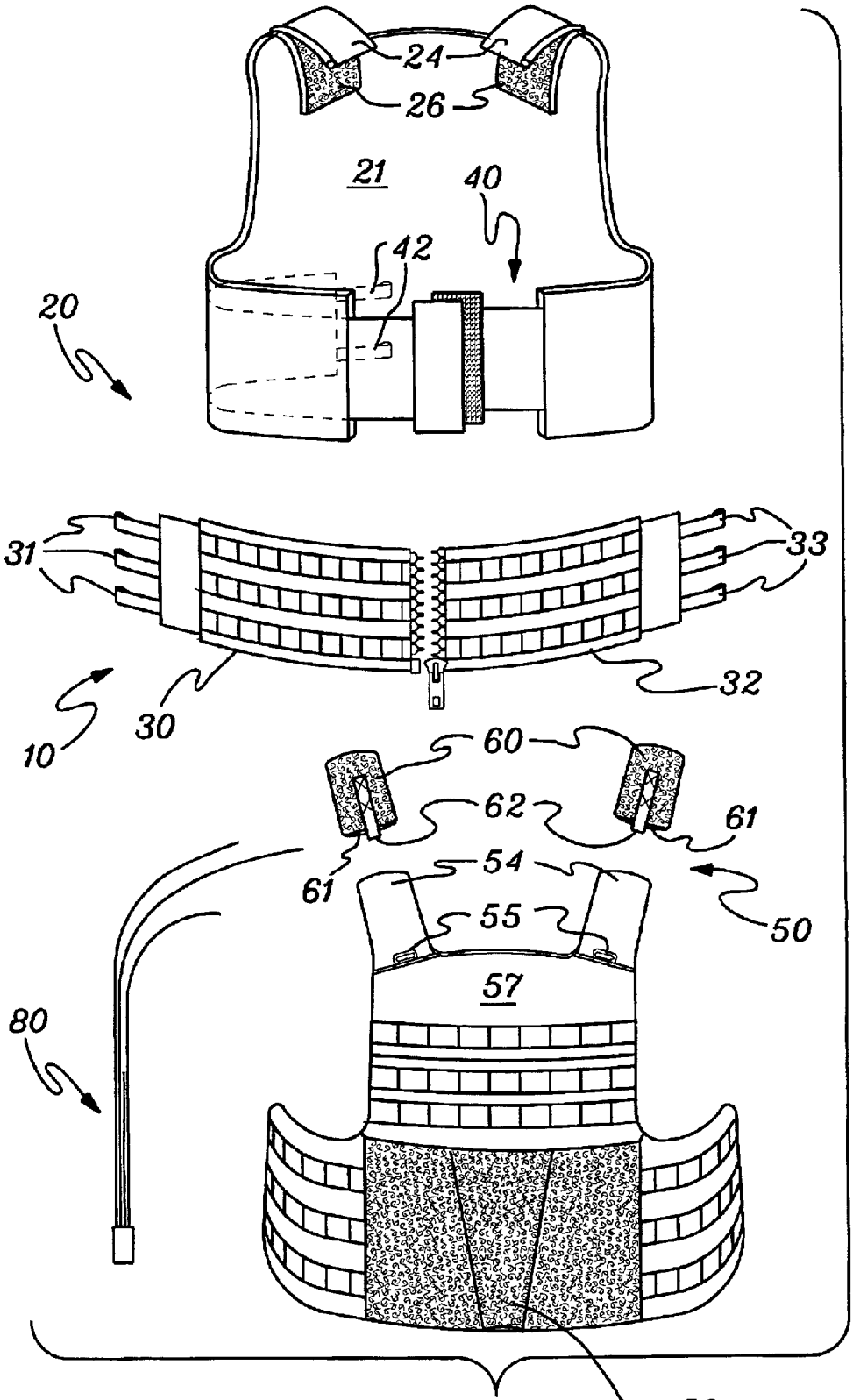
FIG. 3 is an exploded perspective view of the various parts forming the cutaway vest of FIG. 1.

FIGS. 1–3 illustrate one embodiment of a cutaway vest 10 in accordance with the present invention. The cutaway vest, for example, is described and illustrated as a tactical load bearing vest, a body armor vest, or similar type of vest. However, harnesses, backpacks, and other garments, may also be configured with the cutaway features of the present invention.

The cutaway vest generally includes a rear portion 20 having a torso portion 21 and an internal cummerbund 40 (FIGS. 2 and 3), and a front portion 50 having a torso portion 57. The cummerbund provides a more secure fit of the cutaway vest to the wearer and also aids in keeping the rear portion of the cutaway vest properly positioned while the cutaway vest is worn. In addition, in the non-cutaway configuration, the cummerbund positions and stabilizes the rear portion of the cutaway vest while the wearer attaches the sides of the cutaway vest.

As described in greater detail below, a wearer of the cutaway vest in an emergency is able to quickly cutaway, release, or remove the cutaway vest from the wearer's body by pulling a pull cord 80. In this illustrated embodiment, the cutaway vest includes a cutaway attachment in each shoulder and cutaway attachments in the back for generally simultaneously cutting away the shoulders, the sides, and the cummerbund upon pulling and removing pull cord 80 from the cutaway vest.

The cutaway vest may be normally worn, e.g., put on and removed by a wearer, in a manner generally similar to a regular non-cutaway vest. For example, with reference to FIG. 2, the shoulder portions of the cutaway vest would normally be releasably attached together (the shoulder portions being illustrated separated in FIG. 2 for clarity) while the sides of the cutaway garment are releasably attachable. With the shoulder portions releasably attached together, a wearer would initially lift the cutaway vest upwardly and place the shoulder portions over the wearer's head. The wearer, around his waist, would then fasten a front portion of internal cummerbund 40 together. The front portion of the cummerbund may be attachable together using mechanical hook-and-loop fasteners such as VELCRO fasteners, a plurality of releasably attachable snap fasteners, or other suitable fasteners.

With reference still to FIG. 2, a wearer would then position a first side portion 51 of front portion 50 of the cutaway vest between cummerbund 40 and a side portion 30 of rear portion 20 of the cutaway vest, and position a second side portion 52 of front portion 50 of the cutaway vest between cummerbund 40 and a side portion 32 of rear portion 20 of the cutaway vest. The inner surfaces of side portions 30 and 32, and the outer middle portion 53 of front portion 50 may be attachable together using mechanical hook-and-loop fasteners such as VELCRO fasteners. The outermost lateral edges of side portions 30 and 32 of rear portion 20 of the cutaway vest may include a zipper 33.

With reference to FIGS. 2 and 3, each shoulder portion of front portion 50 includes a sleeve 60 having a pocket 61 (FIG. 3) which is fitted over an upwardly-extending tap portion 54 (FIG. 3). Attached to the outside of sleeve 60 is a loop 62, e.g., a folded over one-inch piece of material forming an opening, which extends downwardly from pocket 61 (FIG. 3).

Each shoulder portion of rear portion 20 of the cutaway vest includes an upper flap 24 (FIG. 3) and a lower flap 26 (FIG. 3). Both the top surface and the bottom surface of sleeves 60 may be releasably attachable respectively to the bottom surface of upper flap 24 (FIG. 3) and the upper surface of bottom flap 26 (FIG. 3) using mechanical hook-and-loop fasteners such as VELCRO fasteners, a plurality of releasably attachable snap fasteners, or other suitable fasteners.

As shown in FIG. 3, side portion 30 of rear portion 20 includes three spaced-apart outwardly-extending loops 31, and side portion 32 of rear portion 20 includes three spaced-apart outwardly-extending loops 33. For example, the loops may be a folded over one-inch piece of material forming an opening, e.g., a canvas or nylon material, with a plurality of stitches 39 (FIG. 7) at one-inch intervals so that the loop is adjustable (as described below during assembly) along its length to allow the sides of the cutaway vest to be adjustably sizable around a waist of a wearer.

With reference still to FIG. 3, internal cummerbund 40 at one end thereof has two spaced-apart outwardly-extending loops 42 (shown in dashed lines). The loops may also be a folded over one-inch piece of material forming an opening, e.g., a canvas or nylon material, and stitched at one-inch intervals so that the loop is adjustable (as described below during assembly) along its length to allow the cummerbund to be adjustably sizable around a waist of a wearer.

Figure 4:
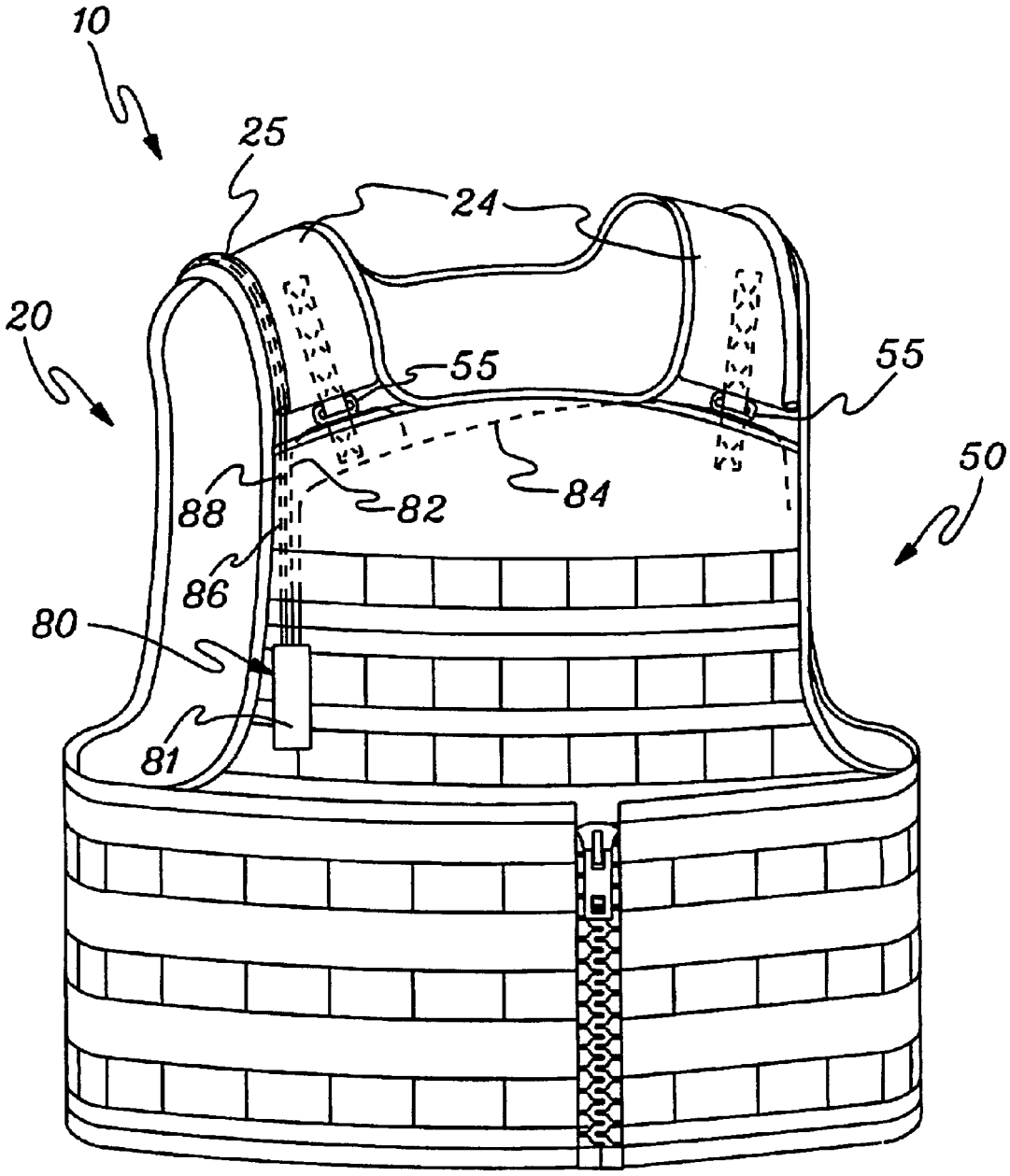
FIG. 4 is a perspective view of the cutaway vest of FIG. 1 showing the pull cord for cutting away the cutaway vest from a wearer.

As shown in FIG. 4, pull cord 80 includes a handle 81 attached to four cables 82, 84, 86, and 88. Each of the cables has a first end which is attached handle 81 and a second free end which is used to lock the loops which hold the cutaway vest together. Cables 82 and 84 are routed along front portion 50 of the cutaway vest to the shoulders, e.g., hidden by a false front that is sewn onto the front of front portion 50 of the cutaway vest. The false front also hides cables 86 and 88 which are routed to the back of the cutaway vest and hidden by a false back sewn onto the rear of the rear portion 20 of the cutaway vest. The cables may comprise a plurality of twisted wires having an outer plastic coating. It will be appreciated that other material, e.g., plastic cords, etc., may be suitably employed for the cables.

Figure 5:
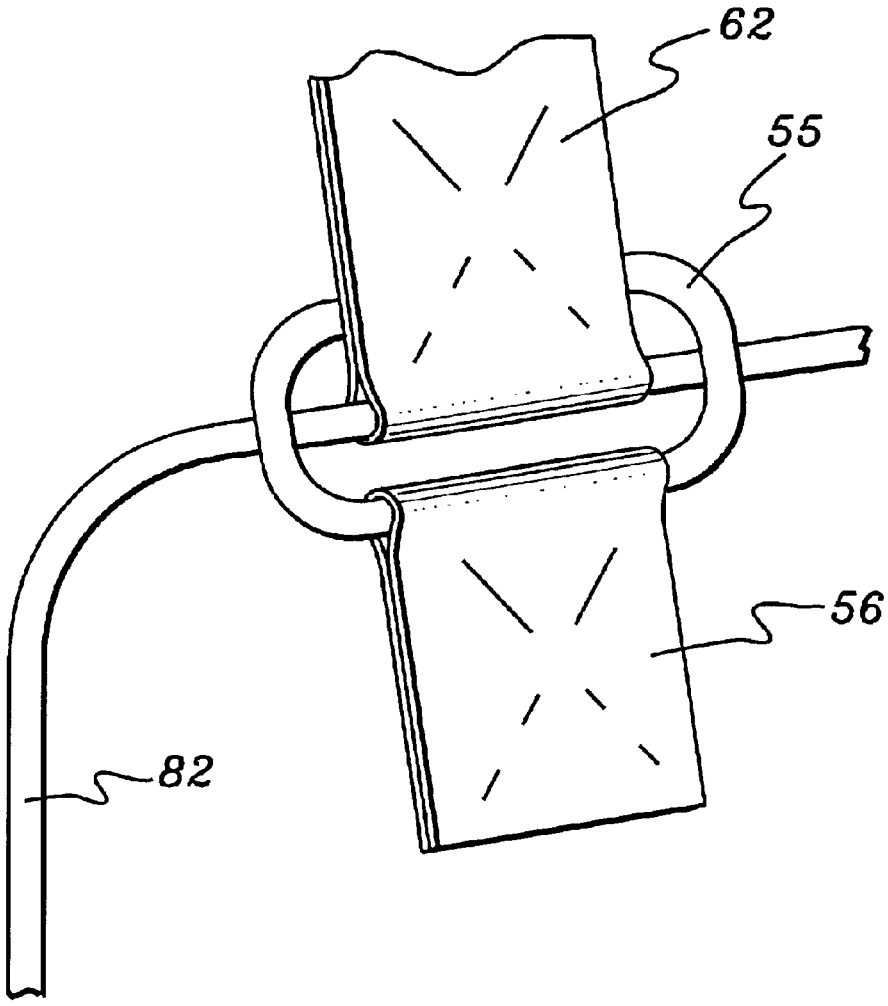
FIG. 5 is an enlarged perspective view of one of the shoulder cutaway attachments shown in FIG. 4.

With reference to FIGS. 3 and 4, one way to assemble the cutaway vest is to insert the cables of pull cord 80 under the false front of front portion 50 and then insert sleeves 60 (FIG. 3) over tabs 54. As shown in FIG. 5, loop 62 is inserted through a ring 55 which is securely attached to the front of front portion 50 of the cutaway vest by a webbing material 56. Cable 82 is then inserted into and through loop 62 to lock loop 62, and thus, sleeve 60 to the front portion of the cutaway vest. The same is repeated for the other shoulder portion with cable 84.

Figure 6:
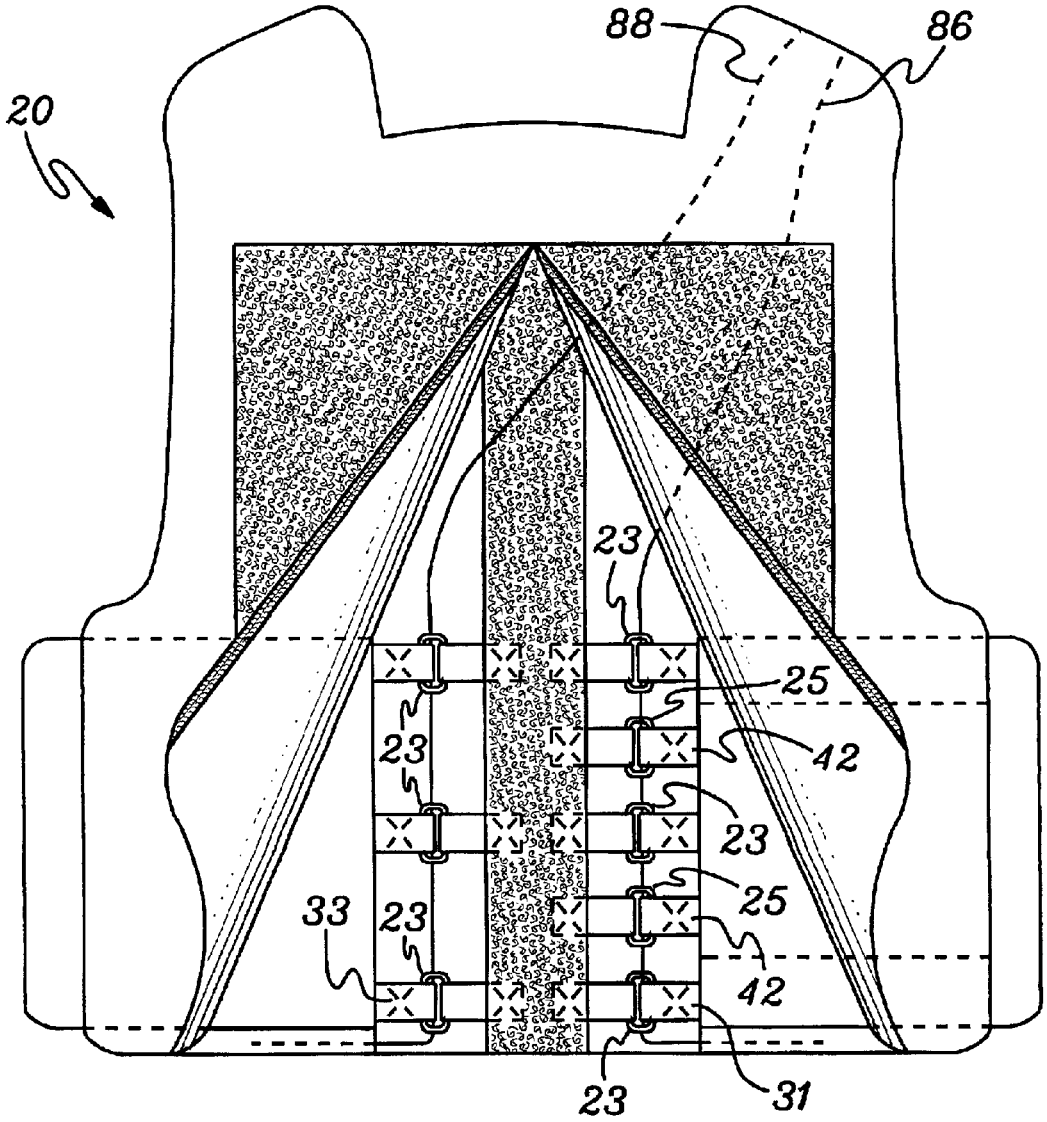
FIG. 6 is a rear elevational view of the cutaway vest of FIG. 1 showing the cutaway attachments of the sides of the front portion and the internal cummerbund to the rear portion of the cutaway vest.

Thereafter, sleeves 60 (FIG. 3) can be releasably attached to respective shoulder flaps 24 and 26 (FIG. 3) of rear portion 20 of the cutaway vest. The sleeves and the flaps being attached with hook-and-loop fasteners, allows adjustable sizing the shoulder portions on the wearer. Cables 86 and 88 are then passed through a channel along lateral edge 25 (FIG. 4) of upper flap 24. As shown in FIG. 6, the cables are then routed under a false back of rear portion 20 of the cutaway vest. An additional cover or other panel may be disposed over the false back and attached to the rear portion, for example, by zippers (not shown).

Figure 7:
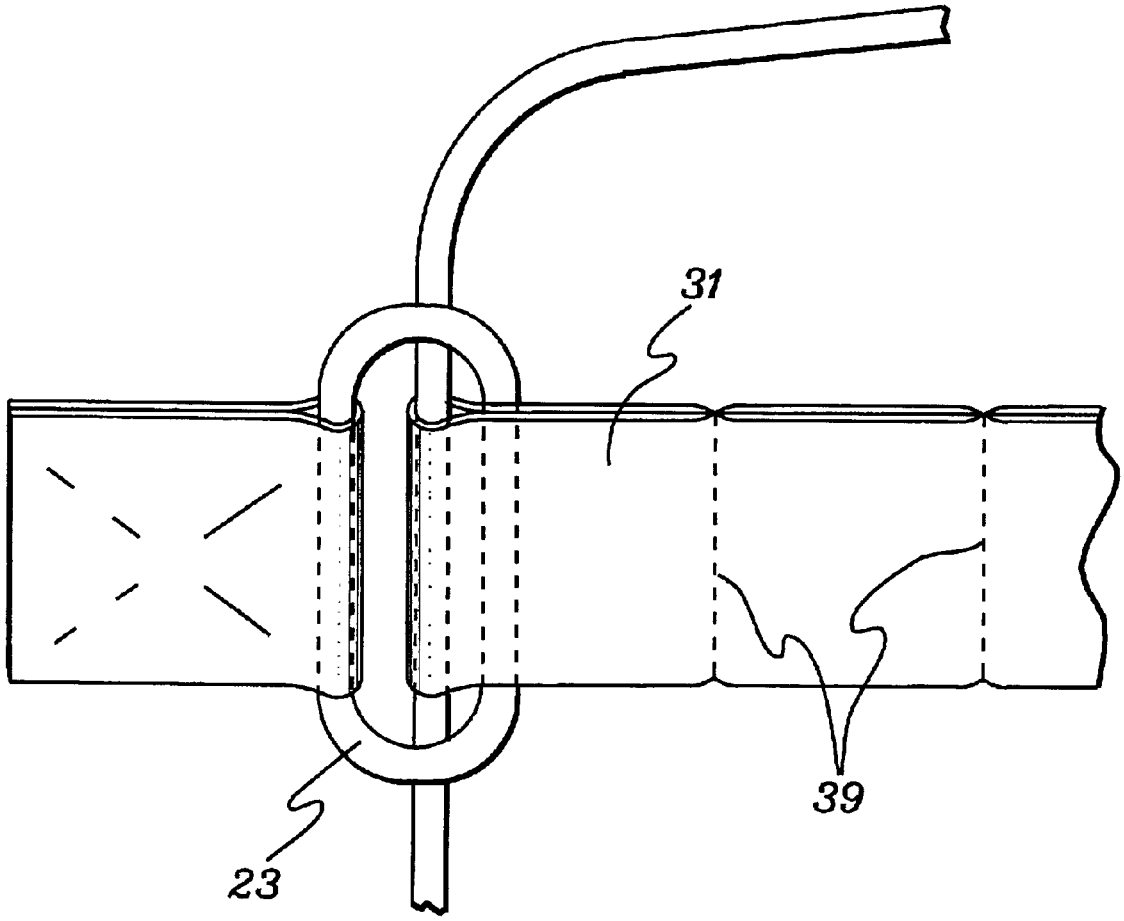
FIG. 7 is an enlarged perspective view of one of the cutaway attachments shown in FIG. 6.

As best shown in FIG. 6, sewn onto the rear of rear portion 20 of the cutaway vest are eight spaced-apart rings 23 and 25. The uppermost, middle, and lowermost rings 23 attach to loops 31 of side portion 32 on one side of the cutaway vest and to loops 33 of side portion 32 on the other side of the cutaway vest. Rings 25 attach to loops 42 of cummerbund 40. Each of the various loops are passed through a respective ring and locked in place by either cable 86 or cable 88. FIG. 7 illustrates the cutaway attachment of one of loops 31 to ring 23.

Figure 8:
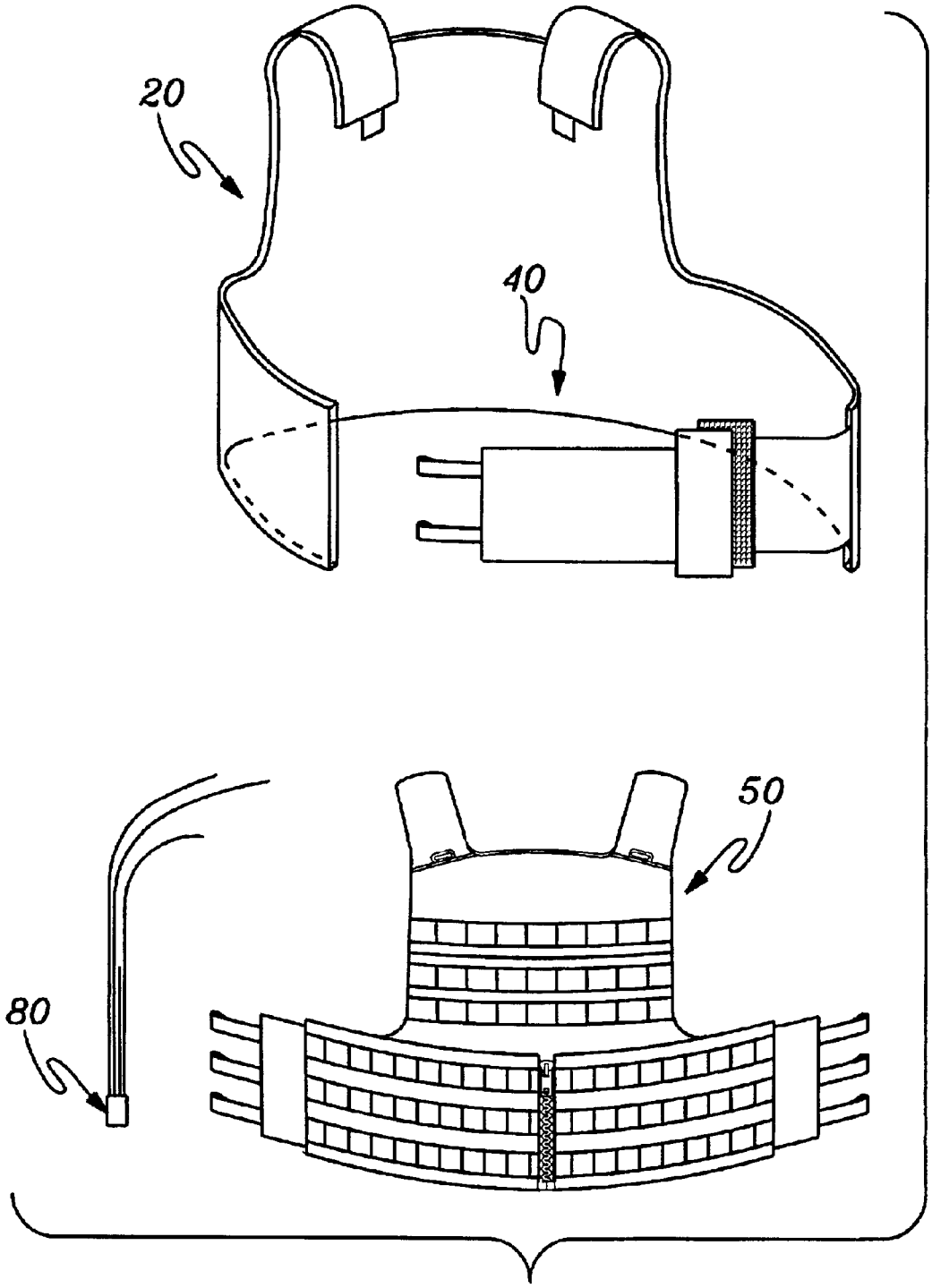
FIG. 8 is an exploded perspective view of the cutaway vest of FIG. 1 shown in an emergency cutaway configuration in which the cutaway vest falls away from a wearer.

After the cutaway vest is assembled and worn by a wearer, the cutaway vest may be easily cutaway in an emergency as shown in FIG. 8. For example, a wearer would pull pull cord 80 downwardly and/or outwardly from the front of the cutaway vest. Upon doing so, the cables attached to the cutaway attachments in the shoulder would disengage from the loops allowing the loops to pass through the rings and the shoulder portions of front portion 50 and rear portion 20 of the cutaway vest to detach and fall away from the wearer. Also, the cables attached to the cutaway attachments along the rear of rear portion 20 of the cutaway vest would disengage from the loops allowing the loops to pass through the rings and the sides of the front portion of the cutaway vest to detach from the rear of the rear portion and fall away from the wearer. In addition, the cables attached to the cutaway attachments along the rear of rear portion 20 of the cutaway vest would allow one end of cummerbund 40 to detach and fall away from the wearer.

Additional features of the cutaway vest include the pull cord being changeable from a right side position to a left side position using the same handle and cables. This is done by each flap 24 of rear portion 20 being made with channels that hide the cables.

The cutaway vest may also use a pull cord located in the center of the vest, e.g., under a false front at a bottom 59 (FIG. 3) of front portion 50 of the cutaway vest. This requires a different pull cord, e.g., different length cables, but can use the same channels in the shoulder flaps of the cutaway vest. The pull cord may include four cables. Two cables may run to each side of the cutaway vest, one to a shoulder and the other to the back. The locking of the loops with the cables may be the same as described above. While the illustrated cutaway vest includes a single handle and a one-step process is required for removal of the cutaway vest, it will be apparent that two separate handles, e.g., one for the shoulders and one for the back, may be provided.

The cutaway vest configured as body armor and/or tactical vests are typically loaded down with ammunition and other equipment. In the event the wearer ends up being in or floating in water, the ability of the wearer to quickly cutaway the vest may reduce the likelihood of the wearer drowning. Also, the cutaway vest allows removal of the vest should the wearer become injured or incapacitated. If the cutaway vest has been cutaway, it again can be reassembled and worn, and if necessary, cutaway again.

For configuration as body armor, the cutaway vest may employ ballistic energy absorbing fabric panels having, e.g., polyaramid fibers. The cutaway vest may be also configured to be adaptable to carry detachable elements such as pockets or auxiliary items.

From the present description, it will be appreciated by those skilled in the art that the rings and loops on the various element may be reversed. In addition, it will be appreciated that instead of rings other elements or a webbing material having an aperture therethrough may be suitable in providing a cutaway attachment in combination with a loop and a cable.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. A cutaway garment comprising:

a front portion having a torso portion, spaced-apart shoulder portions, and opposite side portions;

a rear portion having a torso portion, spaced-apart shoulder portions, opposite side portions, and a cummerbund portion;

a plurality of loops for releasably attaching said spaced-apart shoulder portions of said front portion to said spaced-apart shoulder portions of said rear portion, said side portions of said rear portion to said rear portion, and an end of said cummerbund to said rear portion; and a handle attached to a plurality of cables, said plurality of cables operable to pass through said loops to attach said spaced-apart shoulder portions of said front portion to said spaced-apart shoulder portions of said rear portion, said side portions of said rear portion to said rear portion, and said end of said cummerbund to said rear portion, and wherein removal of said plurality of cables allows cutting away of said spaced-apart shoulder portions of said front portion from said spaced-apart shoulder portions of said rear portion, said side portions of said rear portion from said rear portion, and said end of said cummerbund from said rear portion.

2. The cutaway garment of claim 1 further comprising a plurality of rings, and wherein said loops are passable through said rings to attach said spaced-apart shoulder portions of said front portion to said spaced-apart portions of said rear portion, said sides of said front portion to said rear portion, and said one end of said cummerbund to said rear portion.

3. The cutaway garment of claim 1 wherein said plurality of cables comprises four cables, two for engaging said loops on said shoulder portions of said cutaway garment, and two which extend over said shoulder portions to said rear portion of said cutaway garment to engage said side portions of said rear portion of said cutaway garment and said end of said cummerbund.

4. The cutaway garment of claim 1 further comprising a pair of sleeves and wherein each of said shoulder portions of said rear portion comprises two flaps releasably attachable to said pair of sleeves.

5. The cutaway garment of claim 1 wherein each side portion of said rear portion comprises three of said plurality of spaced-apart loops.

6. The cutaway garment of claim 1 wherein said cummerbund comprises two spaced-apart loops.

7. The cutaway garment of claim 1 wherein one of said side portions of said rear of said cutaway garment comprises three of said plurality of spaced-apart loops, said cummerbund comprises two of said plurality of spaced-apart loops, and wherein one of said plurality of cables passes through said loops of said one of said side portions and said loops of said cummerbund.

8. The cutaway garment of claim 7 wherein said side portions of said rear panel releasably attach to said front portion during normal use.

9. The cutaway garment of claim 1 wherein said plurality of loops comprises overlapping webbing material.

10. The cutaway garment of claim 9 wherein said overlapping webbing material is attached at a plurality of spaced-apart locations to provide adjustment of the size of said cutaway garment and said cummerbund around a wearer.

11. The cutaway garment of claim 1 wherein said handle is interchangeably disposable on one of a right side and a left side of said front portion of said cutaway garment.

12. The cutaway garment of claim 1 wherein said cutaway garment comprises at least one of a tactical load bearing vest and a body armor vest.

13. A cutaway garment comprising:

a front portion having a torso portion, spaced-apart shoulder portions, and opposite side portions;

a rear portion having a torso portion, spaced-apart shoulder portions, opposite side portions, and a cummerbund portion;

a plurality of loops and rings for releasably attaching said spaced-apart shoulder portions of said front portion to said spaced-apart shoulder portions of said rear portion, said side portions of said rear portion to said rear portion, and an end of said cummerbund to said rear portion;

a handle attached to a plurality of cables, said plurality of cables operable to pass through said loops to attach said spaced-apart shoulder portions of said front portion to said spaced-apart shoulder portions of said rear portion, said side portions of said rear portion to said rear portion, and said an end of said cummerbund to said rear portion, and wherein removal of said plurality of cables allows cutting away of said spaced-apart shoulder portions of said front portion from said spaced-apart shoulder portions of said rear portion, said side portions of said rear portion from said rear portion, and said end of said cummerbund from said rear portion;

said plurality of cables comprises four cables, two for engaging said loops on said shoulder portion of said cutaway garment, and two which extend over said shoulder portions to said rear portion of said cutaway garment to engage said side portions of said rear portion of said cutaway garment and said end of said cummerbund; and a pair of sleeves and wherein each of said shoulder portions of said rear portion comprises two flaps releasably attachable to said sleeves, each of said sleeves comprising one of said plurality of loops.

14. A cutaway garment comprising:

a front portion having a torso portion, spaced-apart shoulder portions, and opposite side portions;

a rear portion having a torso portion spaced-apart shoulder portions, opposite side portions, and a cummerbund portion; and means for cutting away said spaced-apart shoulder portions of said front portion from said spaced-apart shoulder portions of said rear portion, said side portions of said rear portion from said rear portion, and a portion of said cummerbund from said rear portion.

15. The cutaway garment of claim 14 further comprising means for releasably attaching said shoulder portions during normal use.

16. The cutaway garment of claim 14 further comprising means for releasably attaching said side portions of rear portion to said front portion during normal use.

17. The cutaway garment of claim 14 wherein said cutaway means comprises a pull cord.

18. The cutaway garment of claim 14 wherein said cutaway means comprises a pull cord having a plurality of cables.

19. The cutaway garment of claim 14 wherein said cutaway means comprises a plurality of loops.

20. The cutaway garment of claim 14 wherein said cutaway means comprises a plurality of rings.

21. The cutaway garment of claim 14 further comprising means for adjustably sizing said cutaway garment and said cummerbund around a wearer.

* * * * *